US010619463B2

(12) United States Patent
Cochran et al.

(10) Patent No.: US 10,619,463 B2
(45) Date of Patent: Apr. 14, 2020

(54) APPARATUS AND METHOD FOR IMPROVING AN ELECTRIC SUBMERSIBLE PUMP SYSTEM

(71) Applicant: ZiLift Holdings, Limited, Aberdeen (GB)

(72) Inventors: Jamie Cochran, Inverurie (GB); Richard McCann, Bakersfield, CA (US)

(73) Assignee: ZILIFT HOLDINGS LIMITED, Aberdeen (GB)

( * ) Notice: Subject to any disclaimer, the term of this patent is extended or adjusted under 35 U.S.C. 154(b) by 189 days.

(21) Appl. No.: 15/815,784

(22) Filed: Nov. 17, 2017

(65) Prior Publication Data

US 2018/0135391 A1 May 17, 2018

Related U.S. Application Data

(60) Provisional application No. 62/423,305, filed on Nov. 17, 2016.

(51) Int. Cl.

| | |
|---|---|
| ***E21B 12/06*** | (2006.01) |
| ***E21B 43/12*** | (2006.01) |
| ***F04C 15/06*** | (2006.01) |
| ***F04C 13/00*** | (2006.01) |
| ***F04C 2/107*** | (2006.01) |

(52) U.S. Cl.
CPC ..... *E21B 43/128* (2013.01); *F04C 2/1071* (2013.01); *F04C 13/005* (2013.01); *F04C 13/008* (2013.01); *F04C 15/06* (2013.01)

(58) Field of Classification Search
CPC ..... E21B 43/128; E21B 43/121; E21B 12/06
See application file for complete search history.

(56) References Cited

U.S. PATENT DOCUMENTS

| | | | | |
|---|---|---|---|---|
| 8,307,913 | B2 * | 11/2012 | Dolman | E21B 21/003 175/38 |
| 2014/0014358 | A1 * | 1/2014 | Leitch | E21B 27/005 166/369 |
| 2015/0152704 | A1 * | 6/2015 | Tunget | E21B 33/128 166/254.2 |

* cited by examiner

*Primary Examiner* — Catherine Loikith
(74) *Attorney, Agent, or Firm* — Richard A. Fagin

(57) ABSTRACT

An electrical submersible pump system include an electric submersible pump coupled to a lower end of a production conduit extending into a wellbore, the production conduit in fluid communication with a discharge of the electric submersible pump and with a well conduit extending to the surface. A bypass conduit is nested inside the production conduit and is in fluid communication with the discharge. The check valve is opened when flow is established in the annular space and is otherwise closed. The bypass conduit extends for a selected distance above the discharge. The bypass conduit has a plurality of selected diameter apertures through a wall of the bypass conduit to enable flow into the annular space.

24 Claims, 4 Drawing Sheets

APPARATUS AND METHOD FOR IMPROVING AN ELECTRIC SUBMERSIBLE PUMP SYSTEM

CROSS REFERENCE TO RELATED APPLICATIONS

Priority is claimed from U.S. Provisional Application No. 62/423,305 filed on Nov. 17, 2016, and which is incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure is generally related to the field of electrically powered submersible well pumps. More specifically the disclosure is related to electrically powered submersible pumps such as electric submersible progressive cavity pumps ("ESPCPs"). More specifically, the disclosure relates to accessories that can be used with ESPCP systems and methods for improving performance when pumping solids laden fluids.

ESPCPs are known in the art for lifting liquid in a subsurface wellbore, as examples, in cases where energy in a subsurface reservoir penetrated by the wellbore is insufficient to lift the fluid to the surface, or where solids produced from the formation such as sand block the flow path in the wellbore so as to reduce productivity of the reservoir of desirable fluids such as oil. Other uses for ESPCPs include lifting water from gas wells to reduce the fluid pressure in the well, thereby increasing gas productivity. Such wells may be drilled through conventional reservoirs, coal bed methane reservoir wells or fractured shale reservoir wells.

ESPCP systems known in the art are often selected to be used over other methods of artificial lift systems due to the improved ability to pump high volumes of solids entrained in the well fluids. However, should flow be interrupted, for example when power is lost momentarily, or when the pump is stopped for other reasons, solids may settle in the wellbore production tubing and cause blockage.

Blockage of the pump caused by sand or other settled solids could result in the pump failing, thereby requiring it to be retrieved from the well. Pump retrieval can be time consuming and productivity is lost from the well during pump retrieval and replacement operations, in addition to the cost to repair or replace the pump prematurely.

ESPCPs are often very good at pumping solids-laden fluids through the pump stator, however solids may pack and block either or both of the intake of the pump or the outlet (discharge) of the pump. Industrial (surface) applications of PCP technology often use an auger to limit entry of the solids into the pump intake at a controlled rate. In subsurface well ESPSP applications, a large diameter auger is impractical and the power required to drive the auger may not be available. Large diameter augers are also susceptible to jamming if too many solids are present in the well fluid.

DETAILED DESCRIPTION

Figure 1:
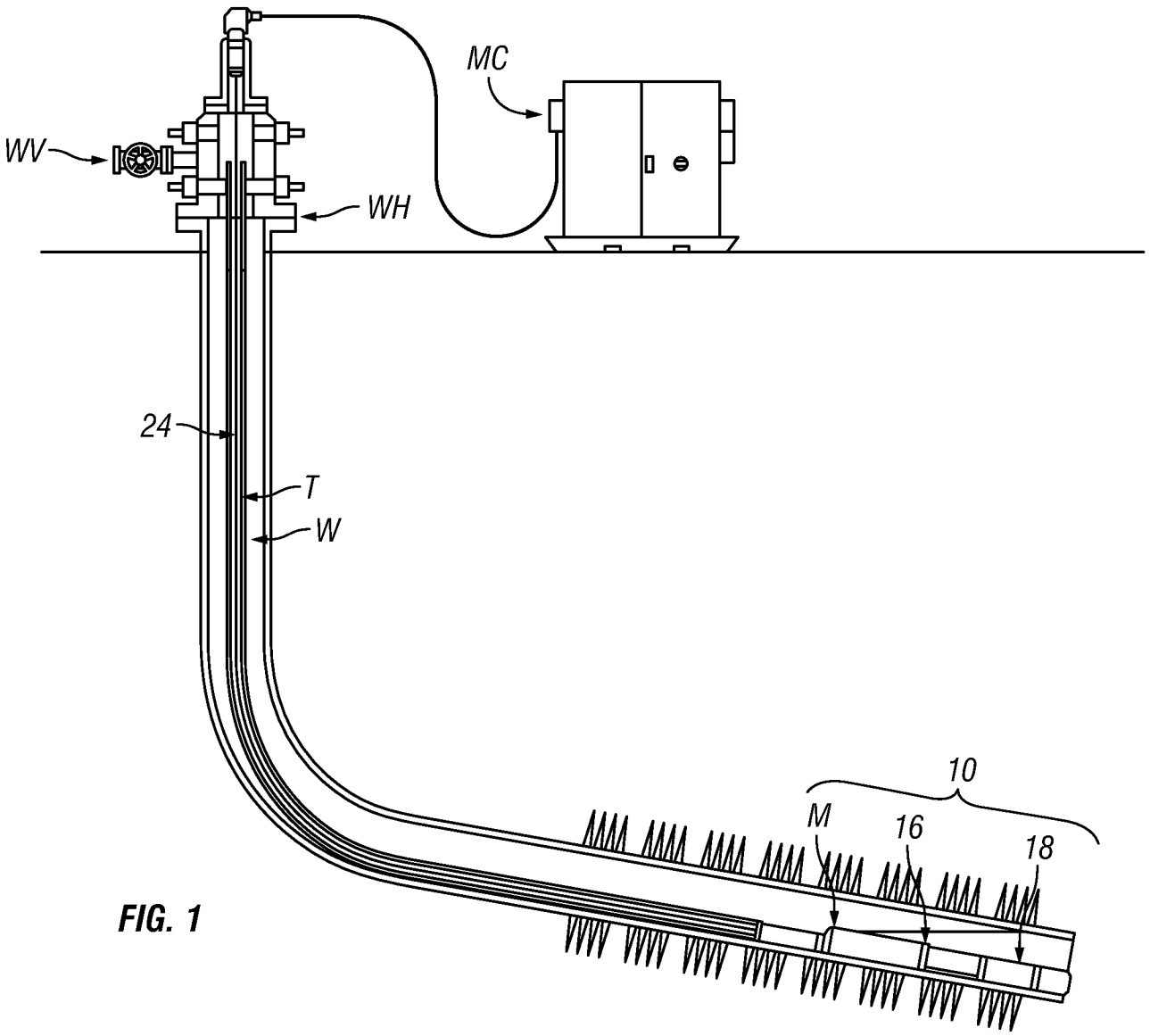
FIG. 1 shows an example embodiment of an electric submersible pump system installed in a wellbore.

FIG. 1 shows an elevational view of an example embodiment of an electric submersible pump system 10 attached to a production tubing T, which may be, for example and without limitation a coiled tubing or a jointed tubing. The electric submersible pump system 10 and production tubing T are disposed in a wellbore W which is drilled through subsurface formations for the production of fluids such as water and/or petroleum. As used herein, the term "petroleum" refers broadly to all mineral hydrocarbons, such as crude oil, gas and combinations of oil and gas. The production tubing T connects the electric submersible pumping system 10 to a wellhead WH located at the surface. Fluid emerging from the wellbore W may pass through a "wing" valve WV forming part of the wellhead WH and thence delivered to suitable produced fluid processing equipment (not shown). Although the electric submersible pumping system 10 is designed to pump petroleum products, it will be understood that the present embodiment of a pumping system can also be used to move other fluids, for example and without limitation, water.

The electric submersible pump system 10 in some embodiments includes a combination of a pump 18 such as a progressive cavity pump, a motor M and a seal section forming part of a drivetrain 14. The motor M may be an electric motor that receives power from a surface-mounted motor control unit MC through a power cable 24. When energized by the motor control unit MC, the motor M drives a shaft (see 16 in FIG. 2) that causes the pump 18 to operate. The seal section in the drivetrain 14 shields the motor M from mechanical thrust produced by the pump 18 and provides for the expansion of motor lubricants during operation. The seal section also isolates the motor M from the well fluids present in the pump 18.

The electric submersible pumping system 10 may also include an intake sub and brush assembly that will be explained in more detail below.

Figure 2:
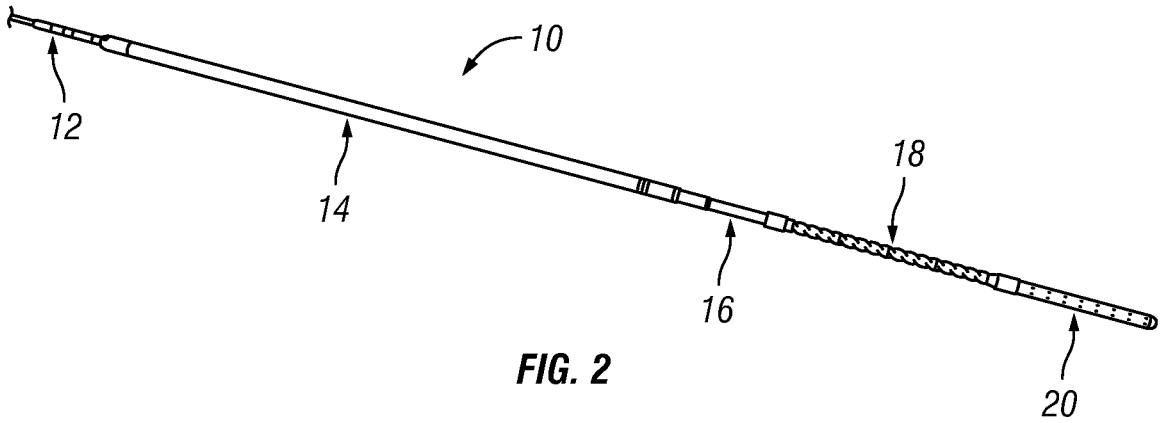
FIG. 2 shows an example embodiment of an electric submersible pump having an annular check valve and intake with a rotary brush according to the present disclosure.

FIG. 2 shows one example embodiment of an electric submersible pump system 10, i.e., an electrically operated submersible progressive cavity pump (ESPCP) system ("pump system") configured to be deployed in a subsurface wellbore at the end of a coiled tubing or other tubing such as shown at T in FIG. 1. A top connector assembly 12 may be used to make a mechanical connection between the end of the coiled tubing (FIG. 3) and the pump system 10. Although the example embodiment described herein may be deployed on coiled tubing, it should be understood that other conveyance, such as jointed tubing may be used in some embodiments to equal effect.

The pump system 10 may comprise a drive train assembly enclosed in a shroud, shown generally at reference numeral 14. The drive train assembly 14 may comprise (none shown separately in FIG. 2) a controllable speed electric motor, a protector assembly (a seal to exclude wellbore fluid from entering the drive train assembly), a gearbox and a flexible shaft assembly 16 having a rotary input end coupled to a rotary output of the drive train assembly 14.

A rotary output end of the flexible shaft assembly 16 may be coupled to a rotary input of a progressive cavity pump (PCP) 18 of types well known in the art for wellbore fluid pumping. In the embodiment shown in FIG. 2, a fluid discharge of the PCP 18 may be disposed proximate the axial end of the PCP 18 coupled to the flexible shaft assembly 16. A fluid intake end of the PCP 18 may be disposed proximate the opposite longitudinal end of the PCP 18 as that from the connection to the flexible shaft assembly 16.

A fluid intake (18A in FIG. 5) of the PCP 18 may be coupled to an axially elongated intake sub 20. The axially elongated intake sub 20 will be described in more detail below with reference to FIGS. 4 and 5.

Figure 3:
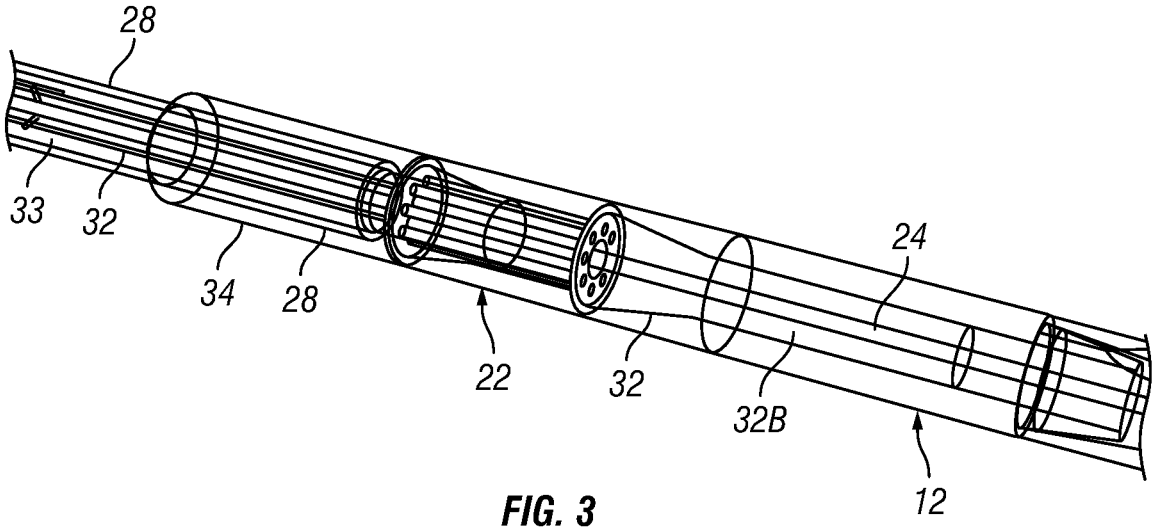
FIG. 3 shows an example embodiment of an annular check valve.

FIG. 3 shows an enlarged view of components in the top connector assembly 12. A tubing end connector 34 may make mechanical coupling to the deployment tubing 28, e.g., coiled tubing. An electrical cable 24 may be nested in the interior of a bypass tube 32 for providing electrical power to a motor (not shown) that drives the PCP (18 in FIG. 2). The bypass tube 32 may be nested in the interior of the deployment tubing 28. Fluid flow from the outlet of the PCP (18 in FIG. 2) may flow through an annulus 33 between the bypass tube 32 and the interior of the deployment tubing 28. In the event the interior of the deployment tubing 28 becomes blocked with settled solids (e.g., sand), a bypass flow path 32B may be provided in the annular space between the power cable 24 and the bypass tube 32. It is contemplated that the bypass tube 32 will extend a longitudinal distance beyond the pump system (10 in FIG. 2) discharge in a direction toward the surface end of the wellbore greater than or equal to the maximum anticipated solids fill height (approximately 50 to 100 feet). The solids fill height may be calculated from solids fraction of the fluid pumped out of the wellbore and the total volume of the interior of the deployment tubing 28 above the pump system (10 in FIG. 2).

A check valve 22 maybe provided in a flow path defined by the annulus 33, i.e., the annular space between the exterior of the bypass tube 32 and the interior of the deployment tubing 28. The check valve 22 may be opened when flow from the PCP (18 in FIG. 2) moves up the annulus 33 and may close to substantially prevent solids entrained in the wellbore fluid above the tubing end connector 34 from settling in the pump system (10 in FIG. 2). The material from which the bypass tube 32 is made may be any suitable conduit material for use in a wellbore and the type of material used for the bypass tube 32 is not a limit on the scope of the present disclosure.

An annular check valve 22 as shown in the figures is only one example embodiment of a check valve. In some embodiments, a flapper type check valve may be used when the bypass tube 32 is not coaxial with the deployment tubing 28.

Figure 4:
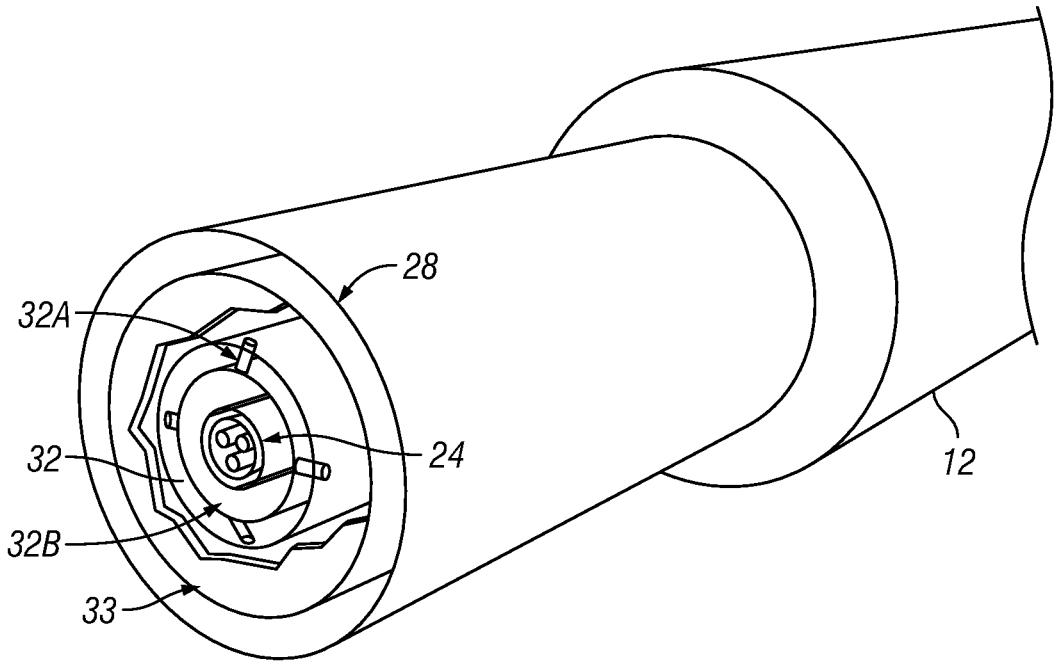
FIG. 4 shows orifices, which may be simple holes or jets of nozzles in a bypass tube.
Figure 5:
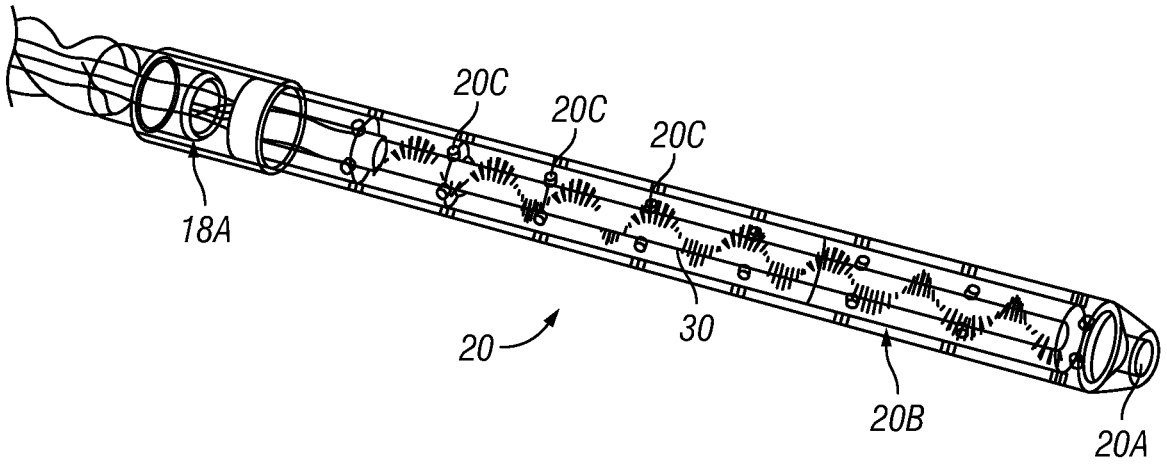
FIG. 5 shows an example embodiment of a pump intake sub with a rotary brush.

FIG. 4 shows a perspective end view of the components in FIG. 4 to assist in better understanding the structure of a pump system according to the present disclosure. The power cable 24 may be any type known in the art for use with electric submersible pumps may be nested in the interior of the bypass tube 32. In the present embodiment, the bypass tube 32 may comprise perforations or apertures 32A along its length, e.g., above the check valve (22 in FIG. 2) to enable the flow of fluid in the bypass tube 32 to assist in dislodging packed, settled solids disposed in the flow path 32B between the deployment tubing 28 and the bypass tube 32.

In some embodiments, the apertures 32A in the bypass tube 32 may be of controlled size to provide increasing friction pressure (pressure drop) as the aperture 32A diameter decreases with respect to distance from the PCP discharge. The apertures 32A could be oriented downward or transverse to the wall of the bypass tube 32 to keep falling sand in the main bore only and/or to create a helical flow. In some embodiments the apertures 32A have a size which is selected to control fluid pressure drop along the bypass tube 32.

The bypass tube 32 may be of the form of a pre-drilled capillary tube or flexible hose which is slid over the power cable 24 of the pump system (10 in FIG. 2) with a seal in the flow path 32B at the upper longitudinal end of the bypass tube 32.

FIG. 3 shows a perspective view of the intake sub assembly 20. The intake sub assembly 20 may comprise an intake conduit or tube 20B made of suitable material to withstand ambient conditions in the wellbore (e.g., steel, aluminum, high melting point plastic). One end of the intake tube 20B is open and may be coupled to the intake 18A of the PCP (18 in FIG. 2). The intake tube 20B may comprise a plurality of openings or perforations 20C to admit fluid from the wellbore into the PCP intake 18A. A rotating brush 30 (shown in more detail in FIG. 5) may be rotationally coupled to the PCP (18 in FIG. 2). An additional fluid intake opening is shown at 20A. The PCP rotor oscillates with a side to side motion as it turns, so rotation of the rotary brush 30 may not be concentric with the longitudinal axis of the pump system (10 in FIG. 1). The brush bristles should support the assembly by lightly touching the interior wall of the intake sub assembly 20.

Figure 6:
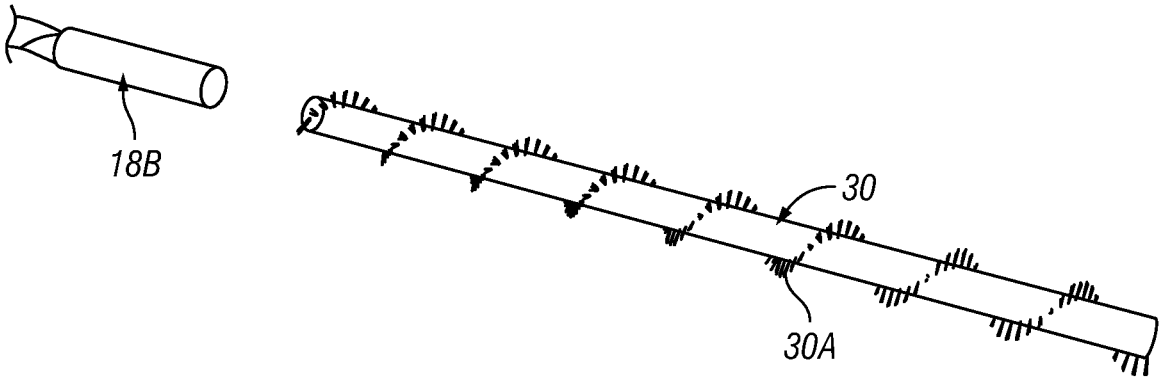
FIG. 6 shows an example embodiment of coupling the rotary brush to the pump shaft.

FIG. 6 shows an exposed, exploded view of the rotating brush 30 and a rotor end 18B of the PCP (18 in FIG. 1). The rotating brush 30 may comprise a helically shaped row of bristles 30A. The bristles 30A may be made from material that is resistant to wear caused by abrasion as a result of moving wellbore fluid containing solids, but sufficiently soft so as not to damage the interior surface of the tube (20B in FIG. 5). In some embodiments, therefore, the intake tube (20B in FIG. 3) may be made from steel and have a wear resistant layer disposed on the interior surface of the tube (20B in FIG. 3). Examples of materials for a wear resistant layer include, for example and without limitation, tungsten carbide.

In some embodiments, the intake tube (20B in FIG. 3) may be omitted and the bristles 30A may protrude outwardly enough to contact the interior surface of the wellbore casing or the wellbore wall. In some embodiments, the bristles 30A may be sufficiently robust to survive rotating in a wellbore environment for at least two years without disintegrating. Stiff, yet suitably compliant bristles 30A may be used to obtain a selected balance between reliability and cleaning action. In some embodiments, the helical row of bristles 30A could also be configured to be conical in shape.

A longitudinal end of the rotating brush 30 may be rotationally coupled to the longitudinal end of the PCP rotor shaft 18A. Rotational coupling may be any device that enables transfer of torque between the PCP rotor shaft 18A and the rotating brush 30, including without limitation, threaded connection (in some embodiments having a handedness opposed to the direction of rotation of the PCP rotor shaft 18A), splined connection, pinning, welding and other non-circularly-shaped torque transmitting features.

A pump system according to the present disclosure may provide one or more of the following benefits. The pump system may be self-clearing so that solids settled when the pump system is switched off or shut down provide less restriction to flow when the pump system is restarted. A pump system according to the present disclosure may be more tolerant to large slugs of solids passing through than pump systems known in the art.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. An electrical submersible pump system, comprising;

an electric submersible pump coupled to a lower end of a production conduit extending into a wellbore, the production conduit in fluid communication with a discharge of the electric submersible pump and with a well conduit extending to the surface;

a bypass conduit nested inside the production conduit and in fluid communication with the discharge;

wherein the bypass conduit extends for a selected distance above the discharge, the bypass conduit having a plurality of selected diameter apertures through a wall of the bypass conduit to enable flow into an annular space between the bypass conduit and the production conduit; and wherein a length of the bypass conduit above the pump discharge is related to a solids fraction of fluid lifted by the pump system and a length of the production conduit above the pump.

2. The system of claim 1 wherein the apertures have a size which decreases with respect to increasing distance above the discharge.

3. The system of claim 1 wherein the apertures have a size which is selected to control fluid pressure drop along the bypass conduit.

4. The system of claim 1 wherein the apertures are at least one of angled toward the discharge and transverse to a longitudinal dimension of the bypass conduit.

5. The system of claim 1 wherein the bypass conduit is closed at an upper end of the bypass conduit.

6. The system of claim 1 further comprising an electric power cable nested inside the bypass conduit.

7. The system of claim 1 wherein the pump is rotated by an electric motor disposed above the pump, and wherein an intake of the pump is disposed at an end of the pump opposite to the end proximate the electric motor.

8. The system of claim 1 wherein the pump comprises a progressive cavity pump.

9. The system of claim 1 further comprising a rotating brush coupled rotationally to a longitudinal end of a rotor of the pump.

10. The system of claim 9 wherein the rotating brush comprises a helically arranged row of bristles.

11. The system of claim 9 wherein the rotating brush is disposed inside an intake tube coupled to an inlet end of the pump, the intake tube comprising a plurality of openings therein to admit fluid into the intake tube.

12. The system of claim 9 wherein the rotating brush comprises bristles having a length sufficient to contact an interior wall of a well casing or a wall of the wellbore.

13. The system of claim 12 wherein the well conduit comprises coiled tubing.

14. The system of claim 1 wherein the production conduit comprises coiled tubing.

15. The system of claim 1 wherein the well conduit comprises coiled tubing.

16. The system of claim 1 further comprising, a check valve disposed in an annular space between the production conduit and the bypass conduit, the check valve open when flow is established in the annular space and otherwise closed.

17. An electrical submersible pump system, comprising:

an electric submersible pump coupled to a lower end of a production conduit extending into a wellbore, the production conduit in fluid communication with a discharge of the electric submersible pump and with a well conduit extending to the surface; and a rotating brush coupled rotationally to a longitudinal end of a rotor of the pump, the rotating brush comprising a helically arrached row of bristles, the rotating brush disposed inside an intake tube coupled to an inlet end of the pump, the intake tube comprising a plurality of openings therein to admit fluid into the intake tube.

18. The system of claim 17 wherein the rotating brush comprises bristles having a length sufficient to contact an interior wall of a well casing or a wall of the wellbore.

19. The system of claim 17 further comprising:

a bypass conduit nested inside the production conduit and in fluid communication with the discharge;

a check valve disposed in an annular space between the production conduit and the bypass conduit, the check valve open when flow is established in the annular space and otherwise closed; and wherein the bypass conduit extends for a selected distance above the discharge, the bypass conduit having a plurality of selected diameter apertures through a wall of the bypass conduit to enable flow into the annular space.

20. The system of claim 19 wherein the apertures have a size which decreases with respect to increasing distance above the discharge.

21. The system of claim 19 wherein the apertures are at least one of angled toward the discharge and transverse to a longitudinal dimension of the bypass conduit.

22. The system of claim 19 wherein the bypass conduit is closed at an upper end of the bypass conduit.

23. The system of claim 19 wherein the selected length of the bypass conduit above the pump discharge is related to a solids fraction of fluid lifted by the pump system and a length of the production tubing above the pump.

24. The system of claim 19 further comprising an electric power cable nested inside the bypass conduit.

* * * * *